US008210264B2

(12) United States Patent
Mohr

(10) Patent No.: US 8,210,264 B2
(45) Date of Patent: Jul. 3, 2012

(54) SUBSEA OVERLOAD RELEASE SYSTEM AND METHOD

(75) Inventor: Harvey O. Mohr, Fredericksburg, TX (US)

(73) Assignees: Techip France, Courbevoie (FR); Nautilus Minerals Pacific Pty Ltd, Milton, Queensland (AU)

( * ) Notice: Subject to any disclaimer, the term of this patent is extended or adjusted under 35 U.S.C. 154(b) by 433 days.

(21) Appl. No.: 12/436,218

(22) Filed: May 6, 2009

(65) Prior Publication Data

US 2010/0282474 A1 Nov. 11, 2010

(51) Int. Cl.
*E21B 23/00* (2006.01)
*E21B 17/02* (2006.01)

(52) U.S. Cl. ..... 166/343; 166/340; 166/355; 166/364; 166/365; 166/367; 285/1; 285/114; 285/922

(58) Field of Classification Search ..... 166/343, 166/339–341, 344, 345, 351, 352, 355, 364, 166/365, 367, 377, 381, 85.1; 285/114, 115, 285/116, 1, 2, 922
See application file for complete search history.

(56) References Cited

U.S. PATENT DOCUMENTS 3,215,204 A * 11/1965 Sims ..... 166/117.5
4,059,288 A * 11/1977 Mohr ..... 285/2
4,880,257 A * 11/1989 Holbert, Jr. ..... 285/2
4,902,045 A * 2/1990 McGugan et al. ..... 285/24
4,984,632 A * 1/1991 Sampa et al. ..... 166/237
5,404,955 A * 4/1995 Echols et al. ..... 166/382
5,549,161 A * 8/1996 Gomez et al. ..... 166/255.1
5,568,836 A * 10/1996 Reid ..... 166/65.1
5,984,006 A * 11/1999 Read et al. ..... 166/63
6,062,312 A * 5/2000 Wilkins ..... 166/340
6,142,233 A * 11/2000 Wilkins ..... 166/339
6,408,946 B1 * 6/2002 Marshall et al. ..... 166/317
6,425,443 B1 * 7/2002 Hill et al. ..... 166/377
6,510,899 B1 * 1/2003 Sheiretov et al. ..... 166/381

(Continued)

FOREIGN PATENT DOCUMENTS

WO 2004/113158 12/2004

(Continued)

OTHER PUBLICATIONS

Bellingacci, F., International Search Report for International Patent Application No. PCT/US2010/033128, European Patent Office, dated Nov. 3, 2010.

(Continued)

*Primary Examiner* — Matthew Buck
(74) *Attorney, Agent, or Firm* — Locke Lord LLP

(57) ABSTRACT

The disclosure provides a subsea overload release system and method. The disclosure provides a releasable connection system than can be overridden during an overload condition, and is resettable in a subsea location in situ. During normal operation, a collet sleeve is slidably engageable with a collet having one or more fingers that can releasably couple a first member with a second member. During an overload condition, an overload piston acting on fluid in an overload reservoir causes an overload pressure and a rupture or other release of fluid through an overload pressure member, causing the overload reservoir to at least partially collapse. The collapse allows the system to extend and force open the fingers to disengage the second member from the first member. When the overload symptom is rectified, the overload reservoir can be reset and the overload pressure member reset or replaced without requiring repairs above sea surface.

10 Claims, 2 Drawing Sheets

U.S. PATENT DOCUMENTS

| | | | | |
|---|---|---|---|---|
| 6,540,024 | B2 * | 4/2003 | Pallini et al. | 166/348 |
| 6,557,637 | B1 * | 5/2003 | Dore et al. | 166/338 |
| 6,571,879 | B1 * | 6/2003 | Bebak et al. | 166/381 |
| 6,827,148 | B2 * | 12/2004 | Shaw et al. | 166/381 |
| 7,040,406 | B2 * | 5/2006 | Dore et al. | 166/338 |
| 7,240,734 | B2 * | 7/2007 | Nivens et al. | 166/339 |
| 7,426,964 | B2 * | 9/2008 | Lynde et al. | 166/377 |
| 2003/0217850 | A1 * | 11/2003 | Shaw et al. | 166/374 |
| 2010/0206561 | A1 * | 8/2010 | Richards | 166/250.17 |
| 2011/0108286 | A1 * | 5/2011 | Richards | 166/381 |
| 2011/0108287 | A1 * | 5/2011 | Richards | 166/381 |
| 2011/0108288 | A1 * | 5/2011 | Richards | 166/381 |

FOREIGN PATENT DOCUMENTS

| | | |
|---|---|---|
| WO | 2009/019515 | 2/2009 |

OTHER PUBLICATIONS

Bellingacci, F., Written Opinion for International Patent Application No. PCT/US2010/033128, European Patent Office, dated Nov. 3, 2010.

* cited by examiner

SUBSEA OVERLOAD RELEASE SYSTEM AND METHOD

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

This disclosure relates to a method and system of securing and releasing subsea connected elements, such as tubular elements. More specifically, the disclosure relates to an overload system and method to facilitate the release of a subsea connection system due to tension overload.

2. Description of the Related Art

Deep water offshore platforms are generally moored to the seafloor through catenary mooring lines and tension cables. These lines are connected between the platforms on one end and structures on the seafloor on the other end. The lengths can be significant and in many cases exceed one or more kilometers (or miles). These lines can also include intermediate connections to assemble a string of such lines to complete the needed length. Further, various piping and other tubing lines for fluids, power, and other functions are connected between the platform and the subsea equipment stationed at a fixed location.

Movement of the platform relative to the seafloor is generally accommodated and factored into the weight, buoyancy, length of the lines, and other parameters so that under normal conditions, the system remains connected between the platform and seafloor. However, there are sometimes unforeseen events that can cause an overload condition. It is known that an overload condition can break, rupture, or otherwise destroy at least a portion of the connections between the platform and the seafloor, sometimes at considerable expense. In general, the components are removed from the sea to a topside or other surface above the sea for repair. Then, the components are replaced or repaired, and reinstalled to their suitable location.

One known connector is disclosed in U.S. Pat. No. 4,902,045. The Abstract states in part, > A connector comprises a first coupling assembly comprising a first coupling member associated with an annular body from which extends a plurality of radially flexible fingers provided at their ends with engagement ribs engageable in grooves in a second coupling member to be abutted against the first coupling member. The fingers are held in their radially inner engaged position by a locking ring axially movable relative to the annular body between a locking position and an inoperative position. The locking ring may be associated a disengagement portion which, as the locking ring moves to its inoperative position, engages the ends of the fingers to move them radially outwardly to disengage the ribs from the grooves. The annular body may be axially movable relative to the first coupling member or fixed relative thereto.

Therefore, there remains a need for a releasable connection system than can be overridden during an overload condition, and is resettable in a subsea position in situ.

SUMMARY OF THE INVENTION

The disclosure provides a subsea overload release system and method. The disclosure provides a releasable connection system than can be overridden during an overload condition, and is resettable in a subsea location in situ. During normal operation, a collet sleeve is slidably engageable with a collet having one or more fingers that can releasably couple a first member with a second member. During an overload condition, an overload piston acting on fluid in an overload reservoir causes an overload pressure and a rupture or other release of fluid through an overload pressure member, causing the overload reservoir to at least partially collapse. The collapse allows the system to extend and force open the fingers to disengage the second member from the first member. When the overload symptom is rectified, the overload reservoir can be reset and the overload pressure member reset or replaced without requiring repairs above sea surface.

The disclosure provides a subsea system for releasing a first member from a second member, comprising: an overload outer sleeve adapted to be coupled to the first member; an overload pressure member coupled to the overload outer sleeve; an overload piston slidably coupled to the overload outer sleeve; a piston extension coupled to the piston; a connector coupled to the piston extension and having a receiving surface; a collet coupled to the connector and having at least one finger; an engagement member adapted to be coupled with the second member and having a mating surface releasably engageable with the receiving surface of the connector; and a collet sleeve having a wall and slidably engageable with the connector and the overload outer sleeve. The overload outer sleeve comprises: an overload sleeve wall; an overload pressure wall disposed at an angle to the overload sleeve wall; and a collet sleeve overload actuator disposed toward the second member, wherein a volume between the overload sleeve wall, the overload pressure wall, the overload piston, and the piston extension forms a collapsible overload reservoir adapted to contain fluid therein. The collet sleeve comprises: a collet sleeve overload receiver disposed toward the collet sleeve overload actuator and adapted to be selectively engaged with the collet sleeve overload actuator; a first port disposed through the collet sleeve wall; a second port disposed through the collet sleeve wall; a collet sleeve piston disposed between the first port and the second port; wherein a volume between the collet sleeve wall, the connector, and the collet forms a connector reservoir in which the collect sleeve piston is slidable. The overload piston is adapted to sealingly engage the overload sleeve wall and cause pressure to increase on a fluid in the overload reservoir when a tensile stress occurs between the first member and the second member. The overload pressure member is adapted to allow fluid to exit the overload reservoir when the pressure of the fluid exceeds a pre-established value to allow the overload piston to move relative to the overload outer sleeve and at least partially collapse the overload reservoir. The collet sleeve overload actuator is adapted to engage the collet sleeve overload receiver when the overload piston is moved relative to the overload outer sleeve and move the collet sleeve in a longitudinal direction away from the second member. The collet sleeve is adapted to engage the finger when the collet sleeve is moved longitudinally away from the second member to pull the finger radially outward from the engagement member and disengage the finger from the engagement member to release the second member.

The disclosure also provides a subsea system for releasing a first member from a second member, comprising: a first portion adapted to be connected to the first member; a second portion adapted to be connected to the second member; a connection portion slidably coupled to the first portion and adapted to releasably engage the second portion; and an overload portion coupled to the first portion and adapted to override the engagement of the connection portion when a tensile stress between the first member and the second member exceeds a pre-determined stress. The connection portion comprises: a collet sleeve slidably disposed relative to the second portion; and a collet slidably coupled to the first portion, the collet having a plurality of flexible fingers adapted to selectively engage the second portion by slidable movement of the collet sleeve relative to the second portion. The overload portion comprises: an overload reservoir; and an overload pressure member adapted to restrict fluid from exiting the reservoir at a pressure below a pre-determined amount.

The disclosure further provides a method of releasably coupling a first member and a second member, the first member having a collet with a plurality of fingers engageable with the second member, the first member being slidably coupled with an overload portion having an overload reservoir and an overload pressure member, comprising: allowing fluid in the overload reservoir to be pressurized above a predetermined pressure based on a tensile stress between the first member and the second member; allowing fluid in the overload reservoir to exit the overload reservoir through the overload pressure member; causing the overload reservoir to at least partially collapse; allowing the first member to move relative to the collet and the second member; and forcing the fingers to radially disengage the second member to releasably uncouple the first member and the second member.

The disclosure further provides a subsea system for releasing a first member from a second member, comprising: a first portion adapted to be connected to the first member; a second portion adapted to be connected to the second member; a connection means for releasably engaging the second portion from the first portion; and an overload means for overriding the engagement of the connection means when a tensile stress between the first member and the second member exceeds a pre-determined stress.

DETAILED DESCRIPTION

Figure 1:
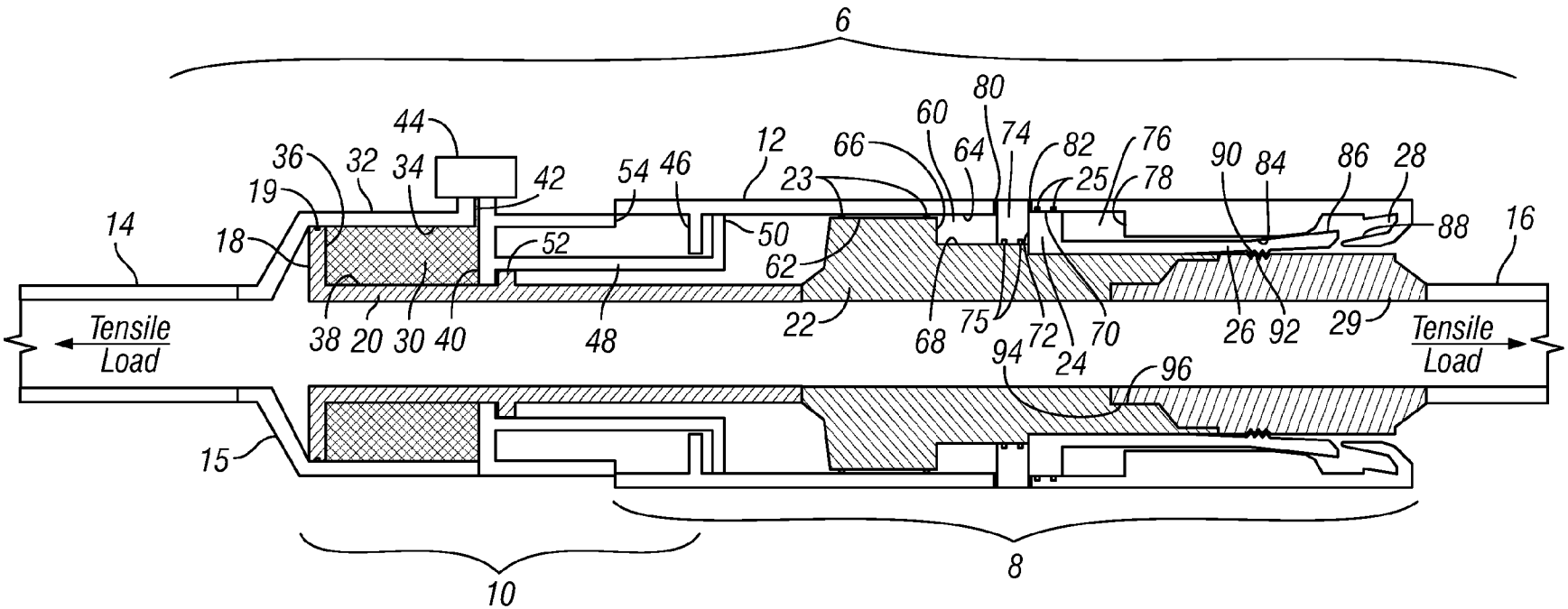
FIG. 1 is a schematic cross-sectional view of an exemplary subsidy overload release system with a first member and second member coupled.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, elements have been labeled with an "a" or "b" to designate one side of the system or another. When referring generally to such elements, the number without the letter is used. Further, such designations do not limit the number of elements that can be used for that function.

In general, the disclosure provides a subsea overload release system and method. The disclosure provides a releasable connection system than can be overridden during an overload condition, and is resettable in a subsea location in situ. During normal operation, a collet sleeve is slidably engageable with a collet having one or more fingers that can releasably couple a first member with a second member. During an overload condition, an overload piston acting on fluid in an overload reservoir causes an overload pressure and a rupture or other release of fluid through an overload pressure member, causing the overload reservoir to at least partially collapse. The collapse of the overload reservoir allows the system to extend and force open the fingers to disengage the second member from the first member. When the overload symptom is rectified, the overload reservoir can be reset and the overload pressure member reset or replaced without requiring repairs above sea surface.

Figure 2:
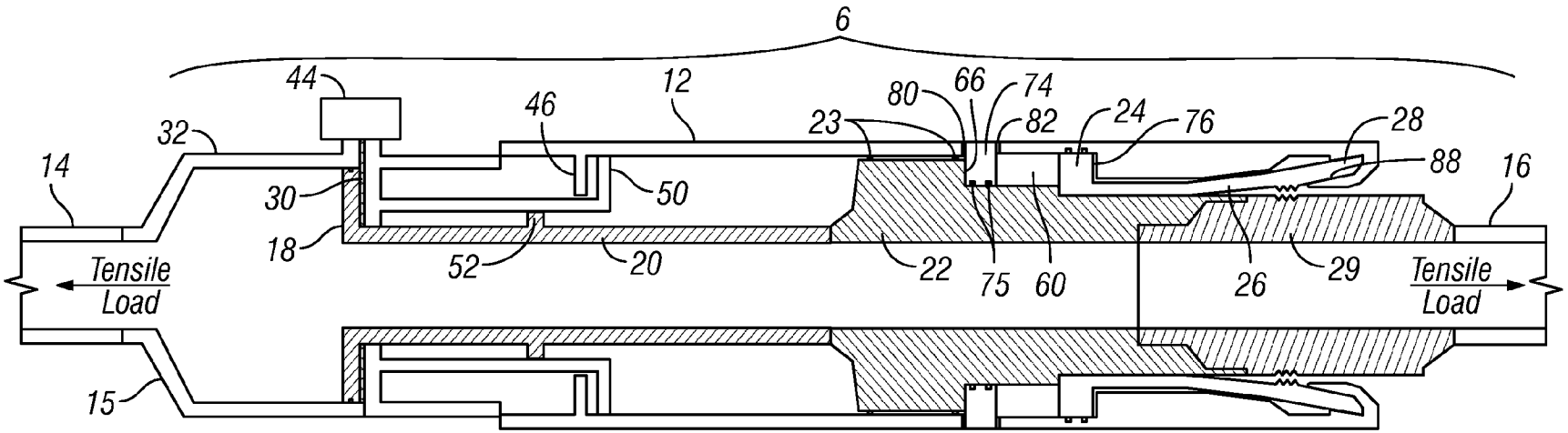
FIG. 2 is a schematic cross-sectional view of an exemplary subsidy overload release system with the first member and second member uncoupled.

FIG. 1 is a schematic cross-sectional view of an exemplary subsidy overload release system with a first member and second member coupled. FIG. 2 is a schematic cross-sectional view of an exemplary subsidy overload release system with the first member and second member uncoupled. The figures will be described in conjunction with each other. The subsea overload release system 6 includes a connection portion 8 and an overload portion 10. The release system 6 is used to couple a first member 14 with a second member 16. Generally, the members can be tubular products, such as pipe, tubing, rods, and other members that require connecting and may be subject to tensile stress overload. The connection portion 8 includes various subsystems and components used to couple the first member 14 with the second member 16. The overload portion 10 generally includes subcomponents and elements used to override the connection portion when an overload condition exists. The two portions are operatively coupled to each other in spatial relationships and are characterized as such for purposes of reference and description.

Starting from the left in the illustration of FIG. 1, a first member 14 is coupled to the overload portion 10. The first member 14 is specifically coupled to an overload interface 15. The overload interface 15 represents an interface between the first member to the first portion and in at least one embodiment is sized and shaped to be fixedly coupled to the first member 14. Further, the overload interface 15 on a distal end forms a transition to an overload outer sleeve 32 used to contain various components of the overload portion 10. In at least one embodiment, the overload outer sleeve 32 can form a cylindrical section. An overload piston 18 is disposed within the overload outer sleeve 32 and slidably engages an overload sleeve wall 34 of the outer sleeve. One or more piston seals 19 can be used to sealingly engage the piston 18 with the overload sleeve wall 34. The piston 18 is formed or otherwise coupled to a piston extension 20. The piston extension 20 extends longitudinally toward the second member 16 and is used to couple various other components of the system, including portions of the connection portion 8, described below. The piston extension 20 further includes a piston stop 52 that is sized and configured to allow a maximum travel of the piston 18 in the direction of the first member 14 inside the overload sleeve wall 34.

An overload reservoir 30 is formed between the overload sleeve wall 34, a piston face 36 of the piston 18, an extension wall 38 of the piston extension 20, and overload pressure wall 40 longitudinally distal from the piston face 36, to form the overload reservoir 30. The fluid in the overload reservoir can be oil, grease or any such fluid. A thixotropic fluid may be advantageous because it would be generally less likely to seep past seals during a prolonged period. For example, and without limitation, a catalyzed silicon rubber fluid could be used.

As the overload outer sleeve slides left relative to the piston 18, as viewed from the illustration in FIGS. 1 and 2, the overload reservoir 30 can collapse in volume as described in more detail below. A port 42 is formed in a portion of the overload outer sleeve and is directed to an external overload pressure member 44. The overload pressure member 44 can include any device that can release fluid in the overload reservoir 30 at or above a predetermined pressure. For example and without limitation, the overload pressure member 44 can include a rupture disc calibrated to release fluid at a predetermined pressure, a relief valve, and other devices that can release fluid at a predetermined pressure. The overload pressure member 44 is generally removably coupled to the overload outer sleeve 32. Advantageously, the overload pressure member 44, when disposed in a subsea location, can be removed and replaced as needed by undersea equipment or personnel, such as divers, remote operated vehicles (ROVs) and other equipment. Thus, the overload portion 10 can be reset in situ without having to remove the components to a surface installation for repair.

The piston extension 20 is used to couple various other components of the overload release system 6, including components of the connection portion 8. Particularly, the piston extension 20 can be coupled to a connector 22 that in at least one aspect forms a receiving surface to receive members coupled to the second member 16. The connector 22 is sealingly engaged within a collet sleeve 12. More specifically, the collet sleeve is slidably disposed relative to the second portion, represented by an engagement member 29, coupled to the second member 16. Further, the collet sleeve 12 is slidably disposed relative to the connector 22 in the collet 24. One or more connector seals 23 coupled to a periphery 62 of the connector 22 sealingly engage a collet sleeve wall 64 of the collet sleeve 12. The collet sleeve 12 is also slidably coupled to the overload portion 10 and components therein.

In general, the collet sleeve 12 is used to engage and disengage components herein that are used to couple the first member 14 with the second member 16 in normal operation, as described below. The overload portion 10 can override the normal operation of the collet sleeve 12 to force a decoupling of the elements to allow first member 14 and second member 16 to be releasably disengaged and decoupled.

A collet 24 is disposed internally to the collect sleeve 12 in at least one embodiment, and fixedly coupled to the connector 22. The collet 24 forms generally a ring that can be segmented or solid, that slidably engages an inner wall of the collet sleeve 12. Further, the collet 24 can sealingly engage the collet sleeve wall 64 with one or more collet seals 25 disposed between the collet periphery 70 and the collet sleeve wall 64. The collet 24 includes one or more segmented extensions, herein referred to as "fingers" 26, that extend longitudinally toward the second member 16. The fingers 26 are used to engage and disengage components attached to the second member to releasably couple the second member with the connector 22 and associated components coupled to the first member 14.

An engagement member 29 represents an interface between the second member 16 and the connection portion 8. The engagement member 29 can be referenced herein as a second portion that can cooperatively be releasably engaged from the connection portion 8 and the first portion of the system through the connection portion. On one end adjacent to the second member 16, the engagement member 29 can be sized to be fixedly coupled to the second member. From a distal end of the engagement member 29, which faces the connector 22, the distal end can be sized to cooperatively engage, and where appropriate, sealingly engage the connector 22. Thus, a connector receiving surface 94 on the connector 22 can be formed to engage an engagement member mating surface 96 of the engagement member 29. Further, the engagement member 29 can be releasably engaged with the fingers 26. Specifically, in at least one embodiment, the fingers 26 can include one or more finger engagement surfaces 90 that can be sized to engage with one or more engagement surfaces 92 on the engagement member 29. In at least one embodiment, the finger engagement surface 90 and the engagement surface 92 can be formed with grooves and ridges to interface with each other and secure the components together.

The connector 22 can be formed with a step in its outer diameter, that is a reduced diameter, forming a volume therebetween that is referenced herein as a collet reservoir 60. The collet reservoir 60 is thus bounded on one end by a connector face 66 of the connector 22, and on a distal end by a collet face 72 of the collet 24, and radially bounded between the collet sleeve wall 64 and the periphery 62 of the connector that creates a cavity. A portion of the collet sleeve 12, herein a collet sleeve piston 74, extends inwardly into the collet reservoir 60. One of more collet sleeve piston seals 75, coupled to the collet sleeve piston 74, sealingly engage the connector wall 68 of the collet 12. The collet sleeve piston 74 can be moved left and right, in the orientation shown in FIGS. 1 and 2, within the collet reservoir 60 between the connector face 66 and the collet face 72, while sealingly engaging the connector wall 68, A first port 80 is formed on one side of the collet sleeve piston 74 and a second port 82 is formed on another side of the collet sleeve piston 74 distal from the first port 80. Further, the collet sleeve 12 is formed with a collet clearance portion 76 having a collet clearance face 78 that allows the collet sleeve piston 74 to reciprocally move left and right within the collet reservoir 60. Fluid can be reciprocally forced into the collet reservoir 60 and released therefrom through the ports, depending on which direction the collet sleeve piston 74 is intended to operate. Fluid can enter one port and exit the other port depending upon the direction of actuation and position of the collet sleeve piston 74. Thus, the collet reservoir 60 can form a sealed reservoir that can be pressurized to actuate the releasably coupling of the first member 14 with the second member 16.

To the right of the collet reservoir 60, as shown in the orientation of FIGS. 1 and 2, the collet sleeve 12 extends adjacent to the engagement member 29 and the fingers 26. The collet sleeve 12 includes a collet sleeve recess 28. The collet sleeve recess 28 can slidably receive an end of the fingers 26. The collet sleeve recess 28 further includes a collet sleeve disengagement surface 88. Generally, the collet sleeve disengagement surface 88 is a tapered surface sized and oriented to receive the end of the fingers 26. The collet sleeve 12 can also include a collet sleeve engagement surface 84 that can engage a finger outer surface 86 of the fingers 26. When the collet sleeve 12 is pulled left in the direction of the first member 14, the collet sleeve disengagement surface 88 can force the fingers 26 to lift off the engagement member 29 in a radially outward direction and disengage the fingers from the engagement member 29. Conversely, when the collet sleeve 12 is moved to the right toward the direction of the second member 16, the collet sleeve engagement surface 84 can force the fingers 26 radially inward into an engaging position with the engagement member 29.

In a normal operation, fluid can be forced through the port 80 and into the collet reservoir 60 between the connector face 66 and the collet sleeve piston 74, that is, to the left of the collet sleeve piston 74. The pressurized fluid in the collet reservoir 60 can force the piston 74 to the right toward the collet 24 and slide the collet sleeve 12 toward the second member 16. Excess fluid in the collet cavity on the other side of the piston 74, that is to the right of the piston 74, can exit through the port 82. As the collet sleeve 12 slides toward the second member 16, the collet sleeve engagement surface 84 can engage the finger outer surface 86 and force the finger 26 into engagement with the engagement member 29. The engagement 29 and the second member 16 coupled with the engagement member are thus engaged and coupled with the connector 22. The system 6 is coupled together with the first member 14 and the second member 16, because the connector 22 is coupled with the piston extension 20 and the piston 18 is fluidicly coupled through the overload reservoir 30 with the overload outer sleeve 32, the overload interface 15, and the first member 14.

Conversely, fluid can be forced through the port 80 and into the collet reservoir 60 between the collet clearance face 68 and the collet sleeve piston 74, that is, to the right of the collet sleeve piston 74. The pressurized fluid in the collet reservoir 60 can force the piston 74 to the left toward the connector face 66 and slide the collet sleeve 12 toward the first member 14. Excess fluid in the collet reservoir 60 on the other side of the piston 74, that is to the left of the piston 74, can be allowed to exit through the port 80. As the collet sleeve 12 slides toward the first member 14, the collet sleeve disengagement surface 88 can engage the finger 26 and force the finger 26 radially outward to disengage the finger from the engagement member 29. The engagement 29 and the second member 16 coupled with the engagement member are thus disengaged and decoupled from the connector 22. The second member 16 is decoupled from the first member 14, because the adapter 29 is decoupled from the connector 22.

One or more spring-loaded pins (not shown) can be disposed at one or more various locations in the collet sleeve 12 to retain the collet sleeve 12 in a fixed position to avoid inadvertent movement when the collet reservoir 60 is not pressurized. The pressure applied to the ports 80, 82 does not have to be retained once the collet 24 and fingers 26 are set in position.

Having described various components of the connector portion 8 and its operation, the interaction of the overload portion 10 with the connector portion 8 can now be further described. In addition to the components described above for the overload portion 10, the overload portion 10 can interface with the connection portion 8 through a series of components described below. The overload portion 10 further includes a collet sleeve overload actuator 50. The actuator 50 is coupled to the overload outer sleeve 32 through an overload inner sleeve 48 and the overload outer sleeve is coupled to the first member 14, as described above. Thus, the collet sleeve overload actuator 50 move in conjunction with movement of the first member 14. In the embodiment shown, the overload actuator 50 is coupled to the overload pressure wall 40, although other suitable locations can be used and such coupling is not limiting.

Corresponding with the collet sleeve overload actuator 50, the collet sleeve 12 includes a collet sleeve overload receiver 46. The collet sleeve overload receiver 46 is disposed to the left of the overload actuator 50 in the orientation of the embodiments shown in FIGS. 1 and 2, and in general is disposed toward the first member 14 relative to the overload actuator 50. Further, there is a gap formed between a portion 54 of the overload outer sleeve 32 and the collet sleeve overload receiver 46. The gap is useful for allowing the collet sleeve piston 74 to reciprocally move left and right in the collet reservoir 60 during normal operation. The collet sleeve overload actuator 50 is disposed adjacent to the overload receiver 46 at a distance so as not to interfere during the normal operation and movement of the collet sleeve piston 74 in the collet reservoir 60. However, when the overload system is activated, as described below, the overload actuator 50 can engage the overload receiver 46 and move the overload receiver 46 to the left in the direction of the first member 14. As the overload actuator 50 moves the overload receiver 46 to the left, the collet sleeve 12 is also moved to the left. The collet sleeve then forces an engagement of the collet sleeve disengagement surface 88 with the finger 26 to disengage the engagement member 29, and thus override the normal operation.

More particularly, when the system 6 encounters an overload condition so that the tensile stress between the first member 14 and the second member 16 exceeds a preestablished value, then the pressure in the overload reservoir 30 increases and exceeds a preestablished value. For example, the tensile stress can be caused by external loads pulling the members away from each other, or by internal pressure stresses that cause tensile stress on the materials of the members or overload system, such as in a finite element analysis, that lead to an overload condition. Upon exceeding the preestablished value, the overload pressure member 44 can release the fluid in the reservoir 30 by rupturing, or otherwise relieving such fluid through the port 42. As the fluid is released, the reservoir 30 at least partially collapses, as shown in FIG. 2. The tensile stress between the first member 14 and the second member 16 causes the overload release system 10 to extend in length. As shown in FIG. 2, the first member 14 is moved toward the left relative to its position in FIG. 1, with the overload outer sleeve 32 coupled to the first member 14 also moved to the left. As the release system extends in length and the first and second member move relative to each other away from each other, the collet sleeve overload actuator 50 engages the collet sleeve overload receiver 46 and pulls or otherwise moves the overload receiver 46 likewise to the left as viewed from the orientation shown in FIG. 2. Consequently, the collet sleeve 12 slides to the left relative to the connector 22, the engagement member 29, and the second member 16. As the collet sleeve 12 moves to the left, the collet sleeve disengagement surface 88 engages the finger 26 and forces the finger to move radially outward to disengage the finger with the engagement member 29. Thus, the overload portion 10 overrides the normal operation of the collet sleeve piston 74 within the collet reservoir 60 using the pressurized fluid through the ports 80, 82. Upon the finger 26 disengaging the engagement member 29, the overload condition can be resolved by the resulting decoupling between the first and second members in a controlled fashion.

Once the overload condition is repaired or otherwise rectified, the first member 14 can be recoupled to the second member 16 in the manner described herein. With the components being subsea, the connection can occur in situ, that is, in place without having to remove the various components to the surface for repair and other remedial action. Further, the overload portion 10 can be restored and reset in situ. Particularly, the overload reservoir can be reestablished by re-injecting fluid into the overload receiver 30 to pull the release system 6 back into a retracted position. Further, if necessary, the overload pressure member 44 can be removed from the release system 6 to reestablish a pressure restricted release on the overload reservoir 30. Thus, the system can be reset and the normal operation of engagement and disengagement using the collet sleeve piston 74 in the collet reservoir 60 can be continued with the overload portion 10 available to handle future, if any, overload conditions.

Other and further embodiments utilizing one or more aspects of the inventions described above can be devised without departing from the spirit of Applicant's invention. Further, the various methods and embodiments of the catamaran system can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A subsea system for releasing a first member from a second member, comprising:

an overload outer sleeve adapted to be coupled to the first member, comprising:
- an overload sleeve wall;
- an overload pressure wall disposed at an angle to the overload sleeve wall; and
- a collet sleeve overload actuator disposed toward the second member;

an overload pressure member coupled to the overload outer sleeve;

an overload piston slidably coupled to the overload outer sleeve;

a piston extension coupled to the piston, wherein a volume between the overload sleeve wall, the overload pressure wall, the overload piston, and the piston extension forms a collapsible overload reservoir adapted to contain fluid therein;

a connector coupled to the piston extension and having a receiving surface;

a collet coupled to the connector and having at least one finger;

an engagement member adapted to be coupled with the second member and having a mating surface releasably engageble with the receiving surface of the connector; and a collet sleeve having a wall and slidably engageable with the connector and the overload outer sleeve, the collet sleeve comprising:
- a collet sleeve overload receiver disposed toward the collet sleeve overload actuator and adapted to be selectively engaged with the collet sleeve overload actuator;
- a first port disposed through the collet sleeve wall;
- a second port disposed through the collet sleeve wall;
- a collet sleeve piston disposed between the first port and the second port;
- wherein a volume between the collet sleeve wall, the connector, and the collet forms a connector reservoir in which the collet sleeve piston is slidable;

the overload piston being adapted to sealingly engage the overload sleeve wall and cause pressure to increase on a fluid in the overload reservoir when a tensile stress occurs between the first member and the second member, the overload pressure member being adapted to allow fluid to exit the overload reservoir when the pressure of the fluid exceeds a pre-established value to allow the overload piston to move relative to the overload outer sleeve and at least partially collapse the overload reservoir, the collet sleeve overload actuator being adapted to engage the collet sleeve overload receiver when the overload piston is moved relative to the overload outer sleeve and move the collet sleeve in a longitudinal direction away from the second member, the collet sleeve being adapted to engage the finger when the collet sleeve is moved longitudinally away from the second member to pull the finger radially outward from the engagement member and disengage the finger from the engagement member to release the second member.

2. The system of claim 1, wherein the collet sleeve further comprises a collet sleeve recess having a collet sleeve disengagement surface, the disengagement surface being adapted to selectively engage the collet finger and radially disengage the finger from the engagement member.

3. The system of claim 1, wherein the overload reservoir is refillable in situ and the overload pressure member is replaceable in situ to allow resetting of the overload portion after fluid is allowed to exit through the overload pressure member.

4. A subsea system for releasing a first member from a second member, comprising:

a first portion adapted to be connected to the first member;

a second portion adapted to be connected to the second member;

a connection portion slidably coupled to the first portion and adapted to releasably engage the second portion, the connection portion comprising:

a collet sleeve slidably disposed relative to the second portion; and a collet slidably coupled to the first portion, the collet having a plurality of flexible fingers adapted to selectively engage the second portion by slidable movement of the collet sleeve relative to the second portion; and an overload portion coupled to the first portion and adapted to override the engagement of the connection portion when a tensile stress between the first member and the second member exceeds a pre-determined stress, the overload portion comprising:

a collapsible overload reservoir adapted to contain fluid therein;

an overload outer sleeve adapted to be coupled to the first member, comprising:

an overload sleeve wall;

an overload pressure wall disposed at an angle to the overload sleeve wall; and a collet sleeve overload actuator disposed toward the second member;

an overload pressure member coupled to the overload outer sleeve and adapted to restrict fluid from exiting the reservoir at a pressure below a pre-determined amount;

an overload piston slidably coupled to the overload outer sleeve; and a piston extension coupled to the piston, wherein a volume between the overload sleeve wall, the overload pressure wall, the overload piston, and the piston extension forms the collapsible overload reservoir.

5. The system of claim 4, wherein the overload reservoir is refillable in situ and the overload pressure member is replaceable in situ to allow resetting of the overload portion.

6. The system of claim 4, the overload piston being adapted to sealingly engage the overload sleeve wall and cause pressure to increase on a fluid in the overload reservoir when a tensile stress occurs between the first member and the second member, the overload pressure member being adapted to allow fluid to exit the overload reservoir when the pressure of the fluid exceeds a pre-established value to allow the overload piston to move relative to the overload outer sleeve and at least partially collapse the overload reservoir.

7. The system of claim 4, wherein the connection portion further comprises:

a connector coupled to the overload portion and having a receiving surface, the collet being coupled to the connector, the second portion comprising an engagement member having a mating surface releasably engageble with the receiving surface of the connector;

the collet sleeve having a wall and slidably engageable with the connector and the overload portion, the collet sleeve comprising:

a collet sleeve overload receiver disposed toward the overload portion;

a first port disposed through the collet sleeve wall;

a second port disposed through the collet sleeve wall;

a collet sleeve piston disposed between the first port and the second port;

wherein a volume between the collet sleeve wall, the connector, and the collet forms a connector reservoir in which the collet sleeve piston is slidable.

8. The system of claim 7, wherein the overload portion further comprises a collet sleeve overload actuator disposed toward the second member, the collet sleeve overload actuator being adapted to engage the collet sleeve overload receiver when the overload piston is moved relative to the overload outer sleeve and move the collet sleeve in a longitudinal direction away from the second member, the collet sleeve being adapted to engage the fingers when the collet sleeve is moved longitudinally away from the second member to pull the fingers radially outward from the engagement member and disengage the fingers from the engagement member to release the second member.

9. A method of releasably coupling a first member and a second member, the first member slidably coupled with collet with a plurality of fingers engageable with the second member, the collet being slidably coupled to a collet sleeve having a collet sleeve overload receiver, and the first member being slidably coupled with an overload portion having an overload reservoir, a collet sleeve overload actuator disposed toward the second member, and an overload pressure member, comprising:

allowing fluid in the overload reservoir to be pressurized above a predetermined pressure based on a tensile stress between the first member and the second member;

allowing fluid in the overload reservoir to exit the overload reservoir through the overload pressure member;

causing the overload reservoir to at least partially collapse;

allowing the collet sleeve overload actuator to engage the collet sleeve overload receiver and move the collet sleeve in a longitudinal direction away from the second member;

allowing the first member to move in a longitudinal direction away from the collet and the second member; and forcing the fingers to radially disengage the second member to releasably uncouple the first member and the second member.

10. A subsea system for releasing a first member from a second member, comprising:

a first portion adapted to be connected to the first member;

a second portion adapted to be connected to the second member;

a connection portion slidably coupled to the first portion and adapted to releasably engage the second portion, the connection portion comprising:

a collet sleeve slidably disposed relative to the second portion;

a collet slidably coupled to the first portion, the collet having a plurality of flexible fingers adapted to selectively engage the second portion by slidable movement of the collet sleeve relative to the second portion; and a connector coupled to an overload portion and having a receiving surface, the collet being coupled to the connector, the second portion comprising an engagement member having a mating surface releasably engageble with the receiving surface of the connector;

the collet sleeve having a wall and slidably engageable with the connector and the overload portion, the collet sleeve comprising:

a collet sleeve overload receiver disposed toward the overload portion;

a first port disposed through the collet sleeve wall;

a second port disposed through the collet sleeve wall;

a collet sleeve piston disposed between the first port and the second port;

wherein a volume between the collet sleeve wall, the connector, and the collet forms a connector reservoir in which the collet sleeve piston is slidable; and the overload portion being coupled to the first portion and adapted to override the engagement of the connection portion when a tensile stress between the first member and the second member exceeds a pre-determined stress, the overload portion comprising:

an overload reservoir;

an overload pressure member adapted to restrict fluid from exiting the reservoir at a pressure below a pre-determined amount; and a collet sleeve overload actuator disposed toward the second member, the collet sleeve overload actuator being adapted to engage the collet sleeve overload receiver when the overload piston is moved relative to the overload outer sleeve and move the collet sleeve in a longitudinal direction away from the second member, the collet sleeve being adapted to engage the fingers when the collet sleeve is moved longitudinally away from the second member to pull the fingers radially outward from the engagement member and disengage the fingers from the engagement member to release the second member.

* * * * *

UNITED STATES PATENT AND TRADEMARK OFFICE

CERTIFICATE OF CORRECTION

PATENT NO. : 8,210,264 B2
APPLICATION NO. : 12/436218
DATED : July 3, 2012
INVENTOR(S) : Harvey O. Mohr It is certified that error appears in the above-identified patent and that said Letters Patent is hereby corrected as shown below:

Title Page, Item (73) Assignee:

"Techip" should be changed to --Technip--

Signed and Sealed this
Eleventh Day of September, 2012

David J. Kappos

David J. Kappos
*Director of the United States Patent and Trademark Office*